United States Patent [19]

Rohr

[11] Patent Number: 5,005,737

[45] Date of Patent: Apr. 9, 1991

[54] FLEXIBLE DISPENSING CLOSURE HAVING A SLITTED RESILIENT OUTLET VALVE AND A FLANGED VENT VALVE

[75] Inventor: Robert D. Rohr, Elgin, Ill.

[73] Assignee: Seaquist Closures, Crystal Lake, Ill.

[21] Appl. No.: 374,155

[22] Filed: Jun. 29, 1989

[51] Int. Cl.[5] ..... B65D 5/72

[52] U.S. Cl. ..... 222/212; 222/490; 137/845; 239/533.13

[58] Field of Search ..... 222/490, 491, 492, 493, 222/92, 206, 209, 212, 213; 92/89; 417/412, 413; 220/209; 239/533.13, 602; 137/843, 845, 851-855

[56] References Cited

U.S. PATENT DOCUMENTS

| | | | |
|---|---|---|---|
| 1,568,233 | 2/1928 | Falk | 222/490 |
| 1,607,993 | 11/1926 | Loewey | 222/490 |
| 2,061,124 | 11/1936 | Walther | 222/490 |
| 2,684,789 | 7/1954 | Marchant | 222/490 X |
| 2,772,817 | 12/1956 | Jauch . | |
| 2,802,607 | 8/1957 | Kalmbach et al. | 222/490 |
| 2,825,603 | 3/1958 | Altegott | 222/215 X |
| 2,937,795 | 5/1960 | Ciliberti | 222/490 |
| 3,176,883 | 4/1965 | Davis | 222/212 X |
| 3,257,046 | 6/1966 | Kasson | 222/490 |
| 3,366,261 | 1/1968 | Dewey | 222/490 X |
| 4,057,177 | 11/1977 | Laauwe . | |
| 4,102,476 | 7/1978 | Loeffler . | |
| 4,513,891 | 4/1985 | Hain et al. . | |
| 4,646,945 | 3/1987 | Steiner et al. | 137/845 X |
| 4,699,300 | 10/1987 | Blake | 222/494 |
| 4,728,006 | 3/1988 | Drobish et al. | 222/213 X |
| 4,747,518 | 5/1988 | Laauwe | 222/153 |
| 4,747,522 | 5/1988 | McIntyre | 222/213 |
| 4,749,108 | 6/1988 | Dornsbusch et al. | 222/212 |
| 4,760,937 | 8/1988 | Evezich | 222/209 X |

FOREIGN PATENT DOCUMENTS 1343415 10/1963 France .

OTHER PUBLICATIONS

Product Profile; ESSEX (Ultraflow).
Product Profile; CONCEPT 2000.

*Primary Examiner*—Michael S. Huppert
*Assistant Examiner*—Kenneth R. DeRosa
*Attorney, Agent, or Firm*—Dressler, Goldsmith, Shore, Sutker & Milnamow, Ltd.

[57] ABSTRACT

A fluid dispensing closure is provided for use on a squeeze-type container. The closure includes a resilient dome member projecting convexly outwardly over the opening. The dome member defines at least one slit extending through the dome member. The dome member is sufficiently resilient to have a normally closed configuration in which the slit is sealed closed when the pressure inside the dome member equals the pressure outside the dome member. The dome member is sufficiently flexible to be deformed further outwardly from and relative to the normally closed configuration for opening the slit when the container is squeezed to exert a predetermined fluid pressure against the inside of the dome member whereby the fluid product can discharge from the container through the open slit.

2 Claims, 1 Drawing Sheet

FIG. 1
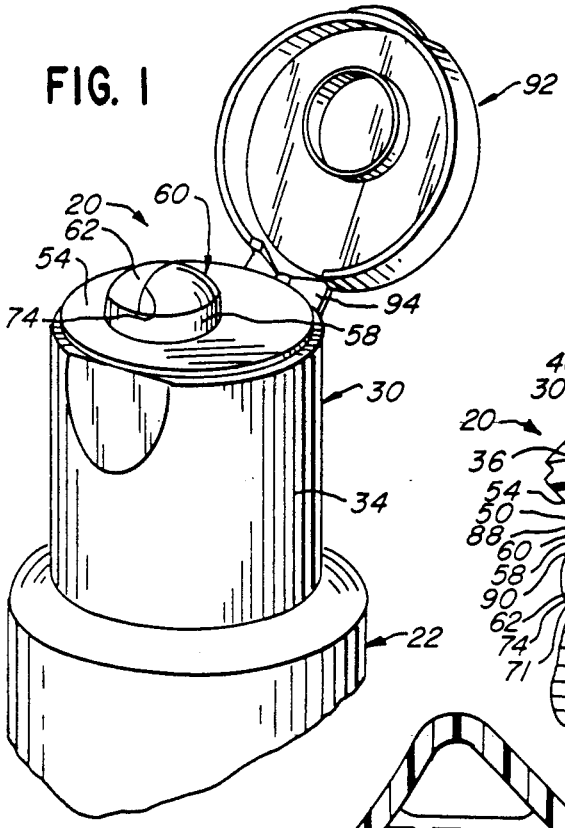
FIG. 2
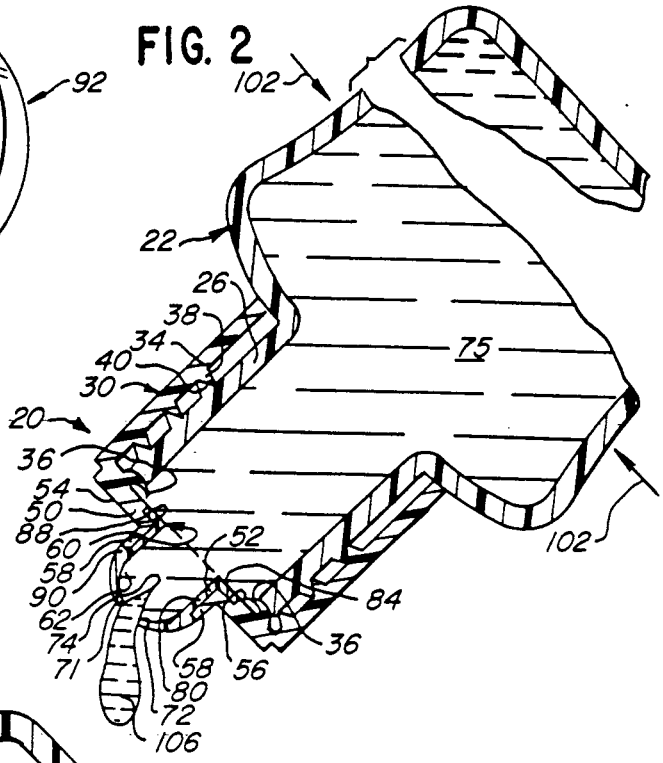
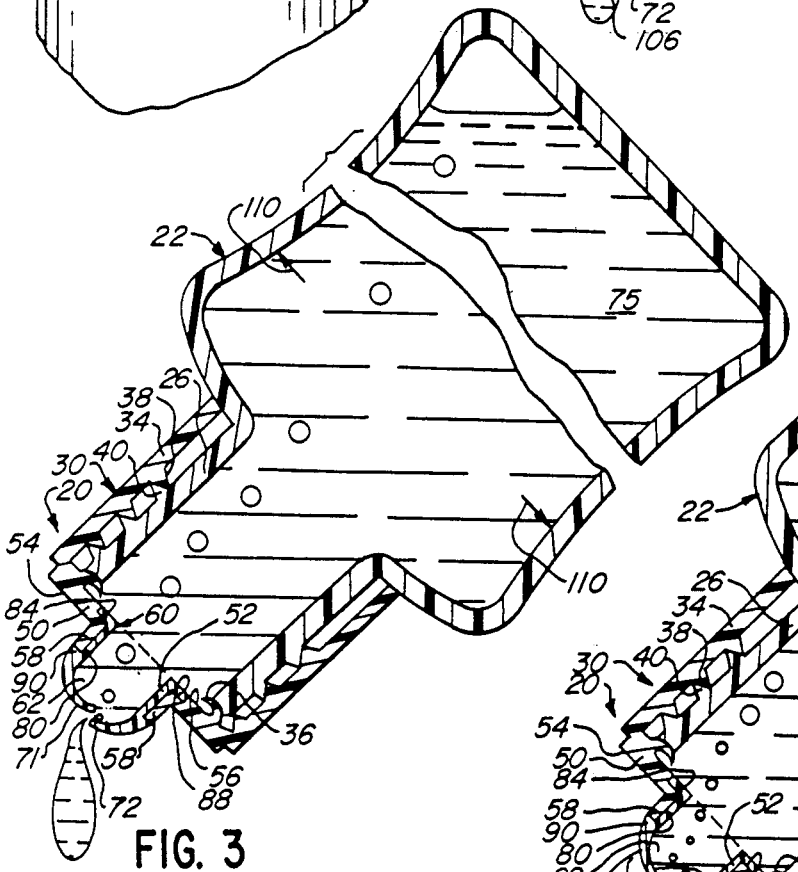
FIG. 3
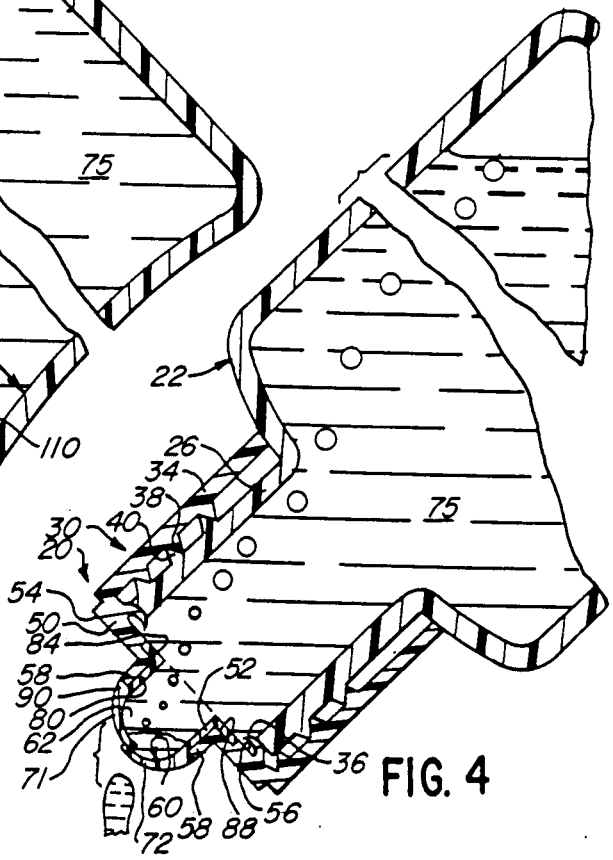
FIG. 4

FIG. 11
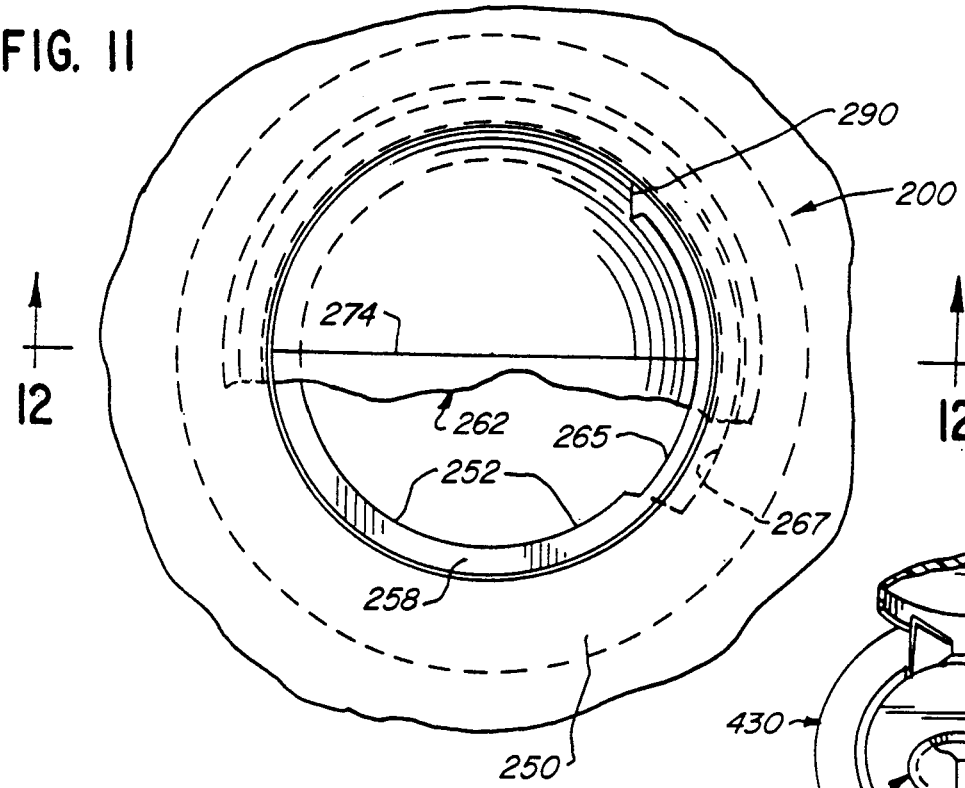
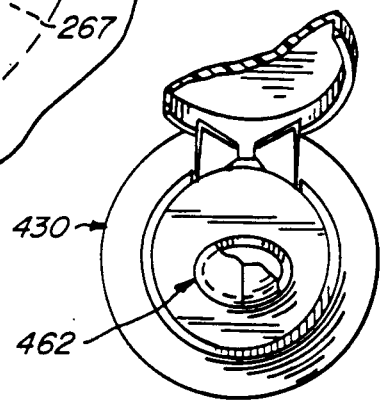
FIG. 14
FIG. 12
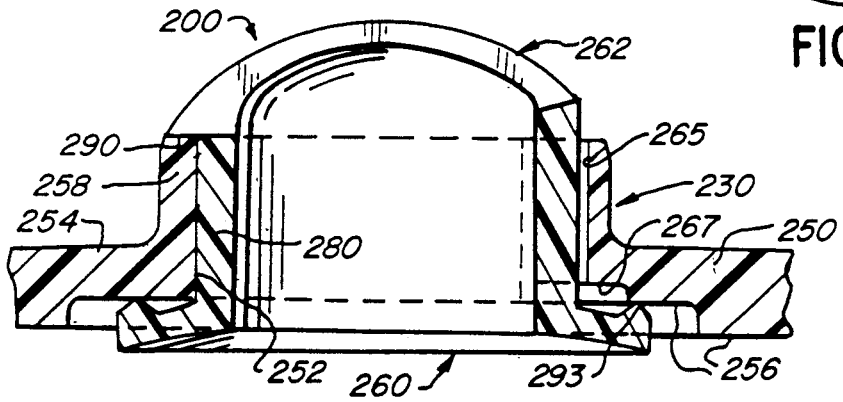
FIG. 13
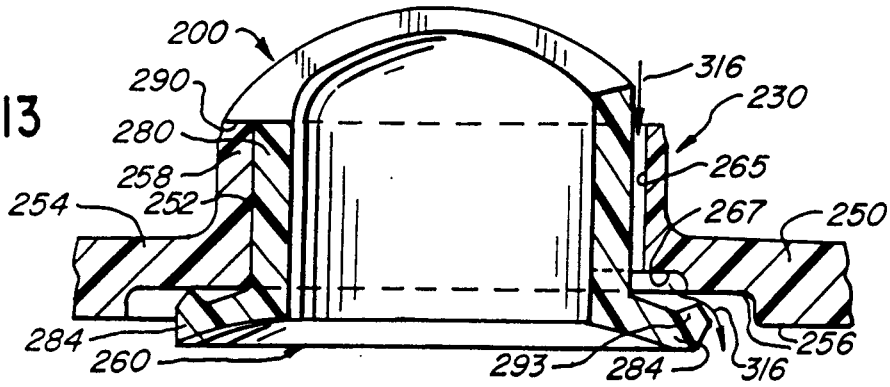

FLEXIBLE DISPENSING CLOSURE HAVING A SLITTED RESILIENT OUTLET VALVE AND A FLANGED VENT VALVE

TECHNICAL FIELD

This invention relates to container closures, and more particularly to squeeze bottle dispensing closures of the type which open to dispense a fluid product from the bottle when the bottle is squeezed and automatically close when the applied squeezing pressure is released.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials.

A popular package design is the squeeze bottle or flexible container which is intended to be squeezed by the user to dispense the product. Such a container typically includes closure through which the product is dispensed. In some designs, the closure automatically closes the dispensing opening and also permits venting of air into the container to equalize the inside and outside pressures when the squeezing pressure is released from the container.

While some such prior art designs are functional, there are a number of disadvantages with such prior art designs. For example, some closures may require the fabrication and subsequent assembly of three or more separate pieces to form the closure.

Some closures do not dispense the fluid product as well as would be desired, and the structural components of the closure may tend to lose the required flexibility or resiliency characteristics that are desirable for continued, long-term operation.

Some types of closures are susceptible to accumulation and congealing of the fluid product at and around the dispensing orifice structure.

U.S. Pat. No. 4,728,007 discloses a resiliently deformable container having a discharge orifice equipped with a self-sealing dispensing valve in the form of a concave diaphragm formed of a resilient material that includes a generally straight line slit from which the fluid product can be dispensed. In operation, when the container is squeezed, a threshold pressure is exceeded to effect inversion of the diaphragm valve from its inwardly concave sealed position to an outwardly distended, convex, open position permitting discharge of the fluid product from the container. The patent describes the structure as inverting by a "snapthrough buckling" so as to pass through an unstable dead-center closed position by "snap-back buckling".

In many fluid dispensing applications, it would be desirable to provide an improved dispensing closure having advantages not found in the closure disclosed in the above-discussed U.S. Pat. No. 4,728,006. In particular, the use of a concave diaphragm valve which inverts by snap-through buckling of the type disclosed in the patent can cause the fluid product to be expelled in a sudden, and not easily controllable, discharge. Indeed, owing to the snap-through buckling action of the resilient diaphragm, the fluid product can be undesirably expelled in a "spitting"-like discharge. It can be difficult for the average user to gently discharge only a small amount of the fluid product. Thus, it would be desirable to provide an improved closure that has a substantially reduced tendency to "spit" out the fluid product and that can be relatively easily controlled with respect to the discharge of initially small amounts of the product.

The use of a concave flexible diaphragm of the type disclosed in the above-discussed U.S. Pat. No. 4,728,006 necessarily results in the discharge end of the closure being generally blunt with a recess. Thus, during the initial positioning and aiming of the container and dispensing closure, the precise point at which the fluid product will be discharged from the inverted flexible diaphragm can be somewhat difficult to judge for the average user. If, for example, it is desired to apply only a very small drop of product on the tip of one's finger, then the initially inverted closure diaphragm, being recessed, would necessarily be located some small distance away from the finger. Owing to the closure structure surrounding the recessed diaphragm, the exact location of the point where the fluid product will be discharged is not readily visualized. Thus, in many applications, it would be desirable to provide an improved closure wherein the point of fluid product discharge is readily observed and initially accessible to facilitate the more precise deposit of a very small amount of the fluid product at a given location.

It would also be desirable to provide such an improved dispensing closure structure with a suitable configuration for functioning, if desired, as an applicator. Then, during and after the discharge of the fluid product from the closure, the closure could be used to spread or otherwise engage the deposited fluid product.

It would also be advantageous to provide such an improved dispensing closure with a configuration that would quickly respond when pressure is applied to squeeze the container. The closure described in the above-discussed U.S. Pat. No. 4,728,006 requires a snap-through buckling movement of the diaphragm from an inwardly concave orientation to an outwardly convex orientation. Until this movement has occurred, the fluid product cannot be dispensed. In some applications, it would be beneficial if a closure could be made more sensitive to the applied squeezing pressure and could therefor function to discharge the fluid product with a reduced "lead time" required to actuate or deform the closure structure to the open position.

As previously noted, the resilient diaphragm valve disclosed in the above-discussed U.S. Pat. No. 4,728,006 is said to invert by snap-through buckling during operation. In some applications, a dispensing closure must be operated many thousands of times. Repeated and severe flexing of some resilient materials might eventually cause failure of the materials or loss of the desired resiliency. Thus, it would be beneficial to provide an improved dispensing closure which would operate with a reduced flexure movement and with reduced stresses so as to provide a relatively greater life cycle. The employment of an improved dispensing closure configuration that operates with reduced flexure and with reduced stresses would desirably permit the fabrication of the closure from other, and less expensive, materials that would otherwise be susceptible to tearing or other failure after a large number of operation cycles.

Further, it would be desirable to provide an improved dispensing closure for use with a squeeze-type package wherein the product flow out of the closure would be cleanly cut off or terminated when the squeezing pressure is released. Also, such an improved dispensing closure should desirably accommodate the dispensing of the fluid product when the container is either upright or inverted. Finally, such an improved dispensing closure should operate to discharge the fluid product without accumulating an undesirable amount of fluid product on the exterior of the closure.

SUMMARY OF THE INVENTION

A fluid dispensing closure is provided for use in a squeeze-type container that defines a discharge opening communicating with the container interior in which a fluid product is contained and that is sufficiently resilient to return to a substantially undeformed condition after applied squeezing forces have been removed.

The closure includes a resilient dome member for being mounted on the container and projecting convexly outwardly over the container discharge opening. The dome member defines at least one slit extending through the dome member. The dome member is sufficiently resilient to have a normally closed configuration in which the slit is sealed closed at least when the pressure inside the dome member equals the pressure outside the dome member.

The dome member is sufficiently flexible to be deformed further outwardly from and relative to the normally closed configuration for opening the slit when the container is squeezed to exert a predetermined fluid pressure against the inside of the dome member whereby the fluid product can discharge from the container through the open slit.

In a preferred embodiment, the dome member is sufficiently flexible to be at least temporarily deformed inwardly from and relative to the normally closed configuration for opening the slit when the pressure outside the dome member exceeds the pressure inside the dome member so as to permit exterior air to be vented into the container to equalize the pressures inside and outside the container.

In the preferred form of the invention, the dome member includes a first wall portion on one side of the slit and a second wall portion on the other side of the slit. The dome member is sufficiently flexible to permit the first and second wall portions to overlap when the dome member is in the normally closed configuration.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a fragmentary, perspective view of a first embodiment of the fluid dispensing closure of the present invention shown mounted on a squeeze-type container with the closure lid in an open position relative to the closure body or base;

FIG. 2 is a fragmentary, cross-sectional view of the container and closure shown in FIG. 1 rotated so that the closure lid is not visible in the plane of the figure and showing the container being squeezed to discharge the fluid product from the closure;

FIG. 3 is a view similar to FIG. 2, but with the squeezing pressure released from the container and the resilient container beginning to return to the substantially undeformed condition whereby the closure begins to close and terminate the discharge of the fluid product as the interior of the container is vented with higher pressure exterior air;

FIG. 4 is a view similar to FIG. 3, but showing the closure in the sealed closed position upon termination of the fluid product discharge from the container;

FIG. 11 is a fragmentary, top plan view of the second embodiment of the closure illustrated in FIGS. 9-10;

FIG. 12 is a fragmentary, cross-sectional view taken generally along the plane 12—12 in FIG. 11 and showing the closure vent valve member in the closed position;

FIG. 13 is a view similar to FIG. 12, but showing the vent valve member in the open position; and FIG. 14 is a fragmentary plan view of a third embodiment of a closure of the present invention with the closure lid shown in the open position.

DESCRIPTION OF THE PREFERRED EMBODIMENTS

Figure 5:
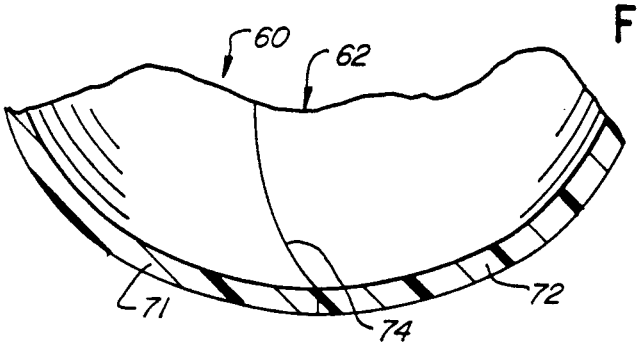
FIG. 5 is a greatly enlarged, fragmentary, cross-sectional view of the resilient dome member of the first embodiment closure illustrated in FIGS. 1-4 shown in an initially fabricated closed position.
Figure 6:
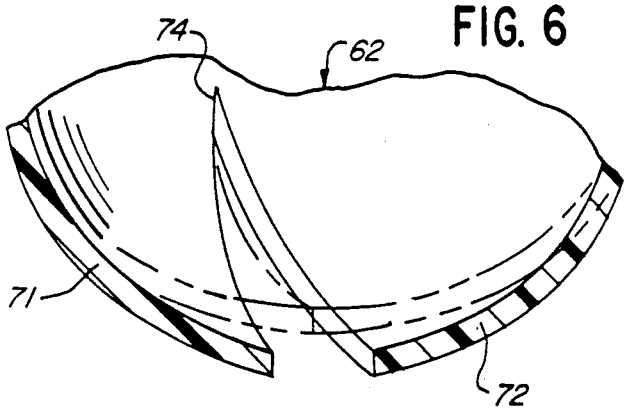
FIG. 6 is a view similar to FIG. 5, but with the dome member deformed outwardly from and relative to the initially fabricated closed configuration illustrated in FIG. 5 so as to open the closure.

While this invention is susceptible of embodiment in many different forms, this specification and the accompanying drawings disclose some specific forms as examples of the use of the invention. The invention is not intended to be limited to the embodiments so described, and the scope of the invention will be pointed out in the appended claims.

The precise shapes and sizes of the components herein described are not essential to the invention unless otherwise indicated. Some of the figures illustrating the preferred embodiments of the dispensing closure of the present invention show structural elements that will be recognized by one skilled in the art. However, the detailed descriptions of such elements are not necessary to an understanding of the invention, and accordingly, are not herein presented.

With reference now to the figures, the first embodiment of the closure of the present invention is represented generally by the numeral 20 in FIGS. 1-8. The closure 20 is adapted to be disposed on a container, such as the container 22 which has a conventional mouth or opening defined by a neck 26 or other suitable structure. The closure 20 may be fabricated from a thermoplastic material, or other materials, compatible with the container contents.

As best illustrated in FIGS. 1 and 2, the closure 20 includes a base, body, or housing 30 for securement to the container 22. In the illustrated embodiment, the housing 30 includes a peripheral wall in the form of a cylindrical skirt or peripheral side wall 34.

As best illustrated in FIG. 2, the housing 30 includes an internal sealing ring 36 which functions as a seal and protrudes against or into the container neck 26 for engaging a peripheral surface of the neck 26 to effect a tight seal.

Further, as best illustrated in FIG. 4, the housing peripheral side wall 34 includes, on its interior surface, a conventional thread 38 or other suitable means (e.g., a snap-fit bead (not illustrated)) for engaging suitable cooperating means, such as a thread 40, on the container neck 26 to releasably secure the housing 30 to the container 22.

In the preferred embodiment illustrated, the housing 30 includes a top wall 50 defining a cylindrical dispensing aperture 52 (FIG. 2). As best illustrated in FIGS. 1 and 2, the top wall 50 has an exterior or upper surface 54 exterior of the container 22 and an interior or lower surface 56 facing the interior of the container 22. The housing 30 further includes a cylindrical collar 58 which projects upwardly from the housing top wall upper around the cylindrical dispensing aperture 52 as best illustrated in FIGS. 1 and 2. The housing 30 may be molded from a suitable thermoplastic material such as, for example, polypropylene.

The closure 20 further includes a resilient insert member 60 mounted within the dispensing aperture 52 of the housing 30. The insert member 60 defines at its upper end a flexible and resilient dome member 62. As best illustrated in FIG. 5, the dome member 62 includes a first wall portion 71 and a second wall portion 72. The wall portions 71 and 72 are divided by at least one through slit 74. The slit 74 functions to permit the discharge of the fluid product 75 from the container in a manner described in detail hereinafter.

In the preferred embodiment illustrated in FIG. 5, the dome member 62 has a generally hemispherical configuration. The wall portions 71 and 72 are of substantially uniform thickness, and the slit 74 has a substantially linear configuration extending across a major portion of the dome member 62.

The insert member 60 includes a hollow cylindrical portion 80 extending inwardly from the dome member 62. The hollow cylindrical portion 80 extends through both the top wall collar 58 and the dispensing aperture 52 of the housing 30. The hollow cylindrical portion 80 is in circumferential sealing engagement with the collar 58 and with the top wall 50 at the dispensing aperture 52.

The innermost end of the insert member 60 terminates in a radially extending flange 84 as best illustrated in FIG. 2. The flange 84 is adapted to engage the lower or interior surface 56 of the housing top wall 50. As illustrated in FIG. 2, the interior surface 56 of the housing top wall 50 defines an annular recess 88 for receiving the flange 84.

The insert member 60 also includes an upper or exterior peripheral shoulder or flange 90 which extends radially outwardly from the dome member 62 on top of the housing collar 58 around the periphery of the cylindrical aperture 52. The upper or exterior flange 90 and the lower or interior flange 84 function to locate and retain the insert member 60 in the housing cylindrical aperture 52.

Finally, a cover 92 is mounted to the edge of the closure housing 30 as illustrated in FIG. 1. The cover 92 is adapted to be pivoted between a closed position over the dome member 62 and an open position spaced away from the dome member 62 (FIG. 1).

The cover 92 may be a completely removable cover. In the preferred embodiment, the cover 92 is connected to the housing 30 by a suitable means, such as a snap-action hinge 94 as illustrated in FIG. 1. Such a snap-action hinge 94 is formed integrally with the closure housing 30 and cover 92. The illustrated snap-action hinge 94 is a conventional type described in U.S. Pat. No. 4,403,712.

The insert member 60 may be fabricated from suitably flexible and resilient materials. These include thermoplastic materials such as polypropylene, polyethylene, copolyester elastomers, polyurethane, various styrenes, and chlorinated olefins. It is also contemplated that other materials may be used, such as thermoset materials including silicone, natural rubber, and ethylene, polypropylene.

The insert member 60 is preferably sufficiently flexible and resilient to accommodate initial insertion of the insert member 60 into the housing 30 during fabrication of the closure 20. However, it will be appreciated that, in another form of the invention, the portion of the insert member 60 within the housing 30 may be rigid, or may be integrally molded as part of the housing 30. In any event, at least the dome member 62 of the insert member 60 is sufficiently flexible and resilient to accommodate operation of the closure to dispense the fluid product from within the container 22.

The closure of the present invention has been found to function well in dispensing a fluid product. In particular, the closure functions initially to retain the fluid product 75 within the container until a predetermined fluid pressure is exerted against the inside of the closure. To this end, when the closure is initially fabricated, the closure dome member 62 has an initially closed position as best illustrated in FIG. 5 wherein the ends of the first and second wall portions 71 and 72 at the slit 74 are generally in registry and in sealing engagement. In this configuration, the slit 74 is closed.

The fluid product 75 may be dispensed from the container 22 by squeezing the container. The fluid product 75 is most conveniently discharged by holding the container in a generally inverted or downwardly angled orientation as illustrated in FIGS. 2–4. While this orientation is not necessary, it allows the fluid product to be readily discharged onto a selected surface.

As best illustrated in FIG. 2, the container 22 is squeezed, as indicated by the inwardly directed force arrows 102 in FIG. 2, to produce a fluid pressure within the container 22 that equals or exceeds a predetermined fluid pressure at which the dome member 62 opens. As the dome member 62 opens, the fluid product 75 is expelled through the slit 74 as a stream or discharge 106.

After the desired amount of product has been dispensed, the squeezing pressure is released from the container 22. Owing to the resilient characteristics of the container 22, the wall or walls of the container 22 return to the substantially undeformed condition in response to the inherent resilient forces schematically represented by force arrows 110 in FIG. 3.

When the squeezing pressure is released, and as the container 22 returns to the undeformed condition, the dome member 62 begins to close to cut off the flow of product 75 from the container 22. As the container 22 continues to return to the undeformed condition, a reduced interior pressure results. The greater pressure exterior of the container forces the dome member wall portions 71 and 72 to be temporarily drawn inwardly from and relative to the originally closed configuration as best illustrated in FIG. 7 (wherein the originally closed configuration is illustrated in phantom by dashed lines and wherein the temporarily inwardly deformed configuration is illustrated in solid lines).

As the discharge of the fluid product is terminated, and the greater exterior pressure forces the ambient atmosphere into the container 22 through the now inwardly open slit 74. This is indicated by the arrow 116 in FIG. 7. Eventually, the interior pressure in the container 22 is equalized with the exterior pressure. At that point, the resiliency of the dome member wall portions 71 and 72 urges the wall portions 71 and 72 to return or spring back outwardly toward the initially closed position.

It has been found that the dome member 62 functions in a unique manner when fabricated from certain materials with certain dimensional relationships. For example, in a preferred embodiment illustrated in FIGS. 1–8, the dome member is fabricated from a chlorinated olefin material having a thickness ranging from about 0.010 inch to about 0.050 inch at the center of the dome. The outer spherical radius of the dome member 62 is about 0.286 inch and the inner spherical radius of the dome member 62 is about 0.246 inch. The inner diameter of the dome member 62 is about 0.320 inch. The cord length of the slit in the dome member 62 is about 0.320 inch.

Figure 7:
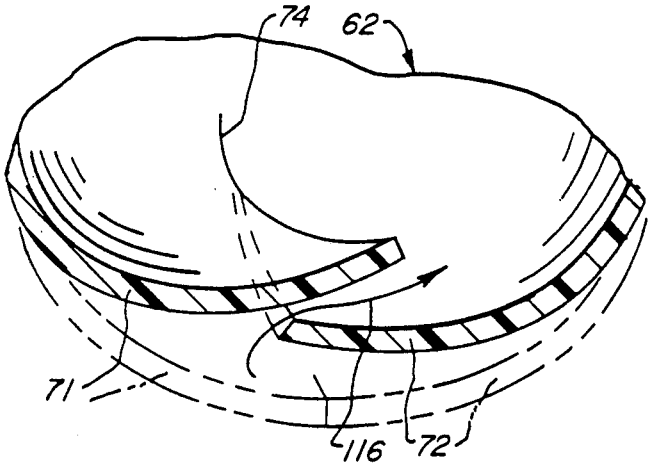
FIG. 7 is a view similar to FIG. 5, but with the dome member shown temporarily deformed inwardly from and relative to the initially fabricated closed configuration illustrated in FIG. 5 so as to open the dome member slit to permit exterior air to be vented into the container.

It will be appreciated that when the dome member wall portions 71 and 72 are in the inwardly deformed, open vent position illustrated in FIG. 7, the edges of the wall portions 71 and 72 are forced into an overlying, but spaced-apart, relationship. It has been found that when the container interior pressure has been equalized with the ambient exterior pressure, the wall portions 71 and 72 do not return completely to the original outermost configuration that was defined by the dome member when it was initially fabricated (i.e., FIGS. 1 and 5). As best illustrated in FIG. 8, the dome member wall portions 71 and 72 remain somewhat inwardly deformed, but are laterally overlapped in sealing engagement along the end edges defining the slit 74.

Figure 8:
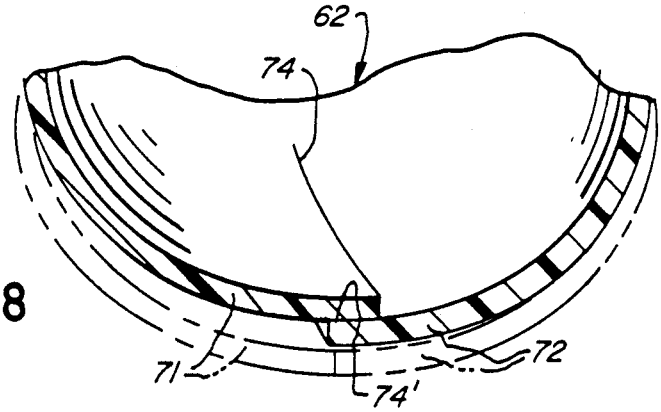
FIG. 8 is a view similar to FIG. 7, but showing the dome member after completion of the venting process wherein first and second wall portions of the dome member overlap in a normally closed configuration.

In the new closed configuration of the dome member as illustrated in FIG. 8, the wall portions 71 and 72 are in a sealing engagement, and the slit 74 may be defined as a slit having an offset or laterally oriented region 74' along the overlapping edges of the wall portions 71 and 72.

It will be appreciated that the wall portions 71 and 72 could be reversed in the closed position with wall portion 72 being located inwardly of wall portion 71.

A second embodiment of the closure of the present invention is illustrated in FIGS. 9–13 and is designated generally therein by the reference numeral 200.

The closure 200 includes a housing 230 somewhat similar to the housing 30 described above with reference to the first embodiment illustrated in FIGS. 1–8. Mounted in the housing 230 is an insert member 260 having a dome member 262. The dome member 262 may be molded from thermoplastic materials or other suitable resilient materials as described above with respect to the first embodiment illustrated in FIGS. 1–8. It is contemplated that the second embodiment dome member 262 would be preferably employed in those applications wherein it is desired to use stiffer materials and/or use a greater thickness of material. However, thinner sections and more flexible materials could also be used.

The second embodiment housing 230 includes a peripheral wall or skirt 234 for being secured to the container (not illustrated) in any suitable manner, including the conventional techniques discussed above with respect to the first embodiment of the closure housing 30 illustrated in FIGS. 1–8.

The closure 230 includes a top wall 250 having an upper or exterior surface 254 and a lower or interior surface 256. A collar 258 projects upwardly from the upper surface 254 of the closure top wall 250. The top wall 250 and collar 258 define a cylindrical dispensing aperture 252 in which the insert member 260 is disposed.

The collar 258 and top wall 250 define a generally vertically oriented channel 265 that is open to the dispensing aperture 252 at one side (as best illustrated in FIGS. 11 and 12) and that defines a vent passage alongside the insert member 260. A portion of the closure housing top wall 250, at the interior or lower surface 256, defines a partially circumferential recess 267 opening to the vertical channel 265.

The insert member 260 includes a hollow cylindrical portion 280 extending inwardly from the dome member 262 through the housing collar 258 and top wall 250 in the dispensing aperture 252. The hollow cylindrical portion 280 is in circumferential sealing engagement with the collar 258 and housing top wall 250 except at the channel 265 and recess 267 where the vent passage is defined alongside the insert member cylindrical portion 252.

Figure 9:
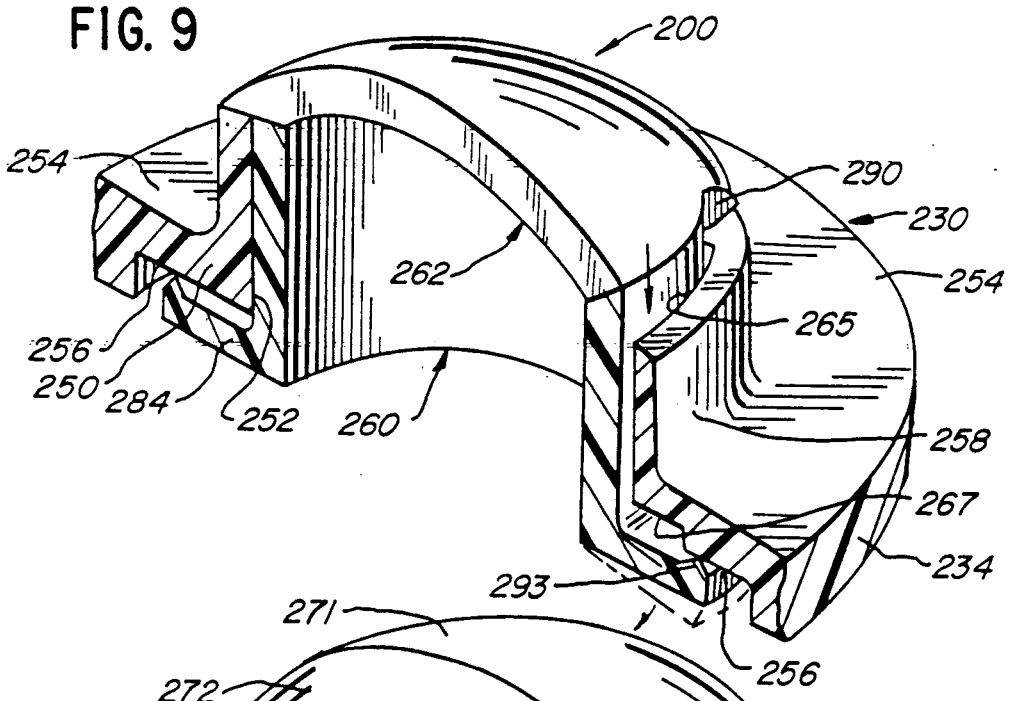
FIG. 9 is a greatly enlarged, fragmentary, cross-sectional view of a second embodiment of the closure of the present invention which includes a vent valve member.
Figure 10:
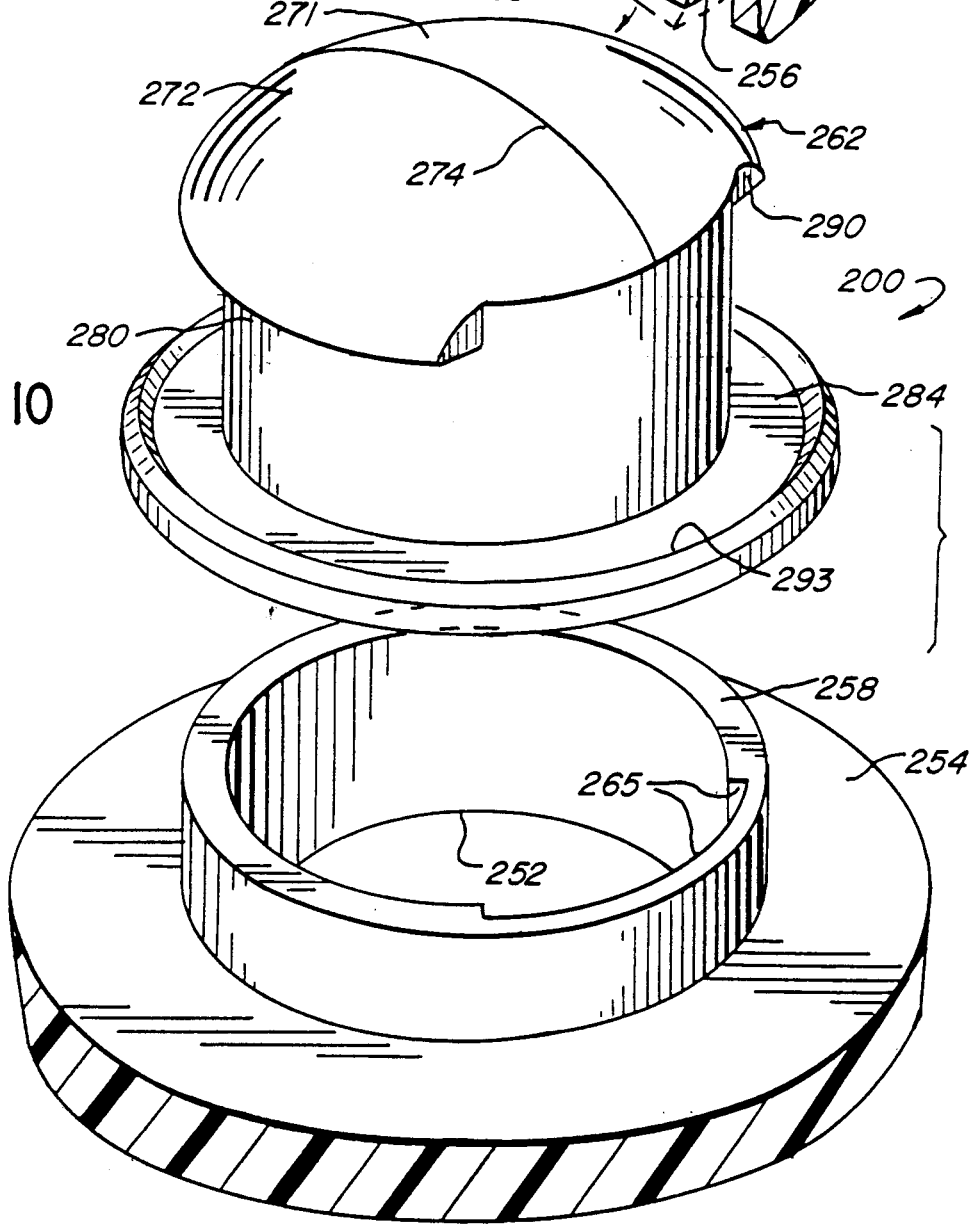
FIG. 10 is an exploded, perspective view, partially in cross-section, of the second embodiment of the closure illustrated in FIG. 9.

As best illustrated in FIG. 9, the insert member 260 has an upper or exterior peripheral shoulder or flange 290 for engaging the top of the housing collar 258. The shoulder or flange 290 is, however, notched or discontinuous at the vent passage channel 265 to permit communication between the interior of the vent channel 265 and the exterior of the housing 230.

The insert member 260 includes an interior or lower peripheral flange 284 at the bottom of the hollow cylindrical portion 280. The flange 284 extends radially outwardly from the hollow cylindrical portion 280 around the periphery of the housing cylindrical aperture 252. The upper flange or shoulder 290 and the lower flange 284 function to locate and retain the insert member 260 in the housing cylindrical aperture 252.

The insert member lower flange 284 also extends radially beyond the recess 267 in the housing top wall 250 and sealingly engages the lower surface 256 of the housing top wall 250 beyond the recess 267. Preferably, as best illustrated in FIGS. 9, 10, 12, and 13, the flange 284 includes an upwardly projecting sealing rim 293 for effecting a peripheral seal against the lower surface 256 of the housing top wall 250.

The dome member 262 of the insert member 260 is provided with a slit 274 from which the fluid product can be discharged. The slit 274 lies generally in a vertical plane across a major portion of the diameter of the dome member 262. In applications wherein the diameter of the dome member 262 is relatively small and/or wherein the thickness of the dome member 262 is relatively great, wall portions 271 and 272 of the dome member 262 on either side of the slit 274 will not deform to as great an extent as the first embodiment dome member wall portions 71 and 72 described above with reference to FIGS. 5-8. Thus, such relatively less flexible wall portions 271 and 272, unlike the wall portions 71 and 72 illustrated in FIGS. 7 and 8, may not deform inwardly sufficiently to permit adequate venting of the container after the fluid product has been discharged and the squeezing pressure has been released.

Instead, alternative or supplemental venting is provided through the vent passage 265 and recess 267. The greater exterior pressure in the passage 265 and recess 267 acts inwardly against the flange 284 to cause the flange 284 to move inwardly away from the lower surface 256 of the housing top wall 250 when the resilient container returns to the substantially undeformed condition. FIG. 13 schematically illustrates the ambient atmosphere venting through the housing 230 as indicated by arrows 316.

It will be appreciated that the dome member (first embodiment dome member 62 or second embodiment dome member 262) may have other suitable shapes. FIG. 14 illustrates an alternate embodiment wherein a dome member 462 has an oval or elliptical shape. Such a differently shaped dome member can be provided in a suitable closure housing 430 which may be similar to the first embodiment housing 30 or second embodiment housing 230 with appropriate modifications as would be apparent to accept the oval shape of the dome member.

The closure of the present invention may be easily fabricated. Only two pieces need be molded—a housing piece and insert member piece having a flexible dome member. Assembly of the two pieces can be readily and easily effected, especially when the entire insert member is molded from a suitable resilient material that can be easily forced into seating engagement within the housing.

The closure of the present invention effectively operates to discharge a fluid product from a squeeze container with little or no spitting and in a manner that can be relatively easily controlled. The amount of flexure or flexing movement to which the closure pieces are subjected is relatively small. Thus, the closure is very responsive to the squeezing action, and the flexing stresses are minimized. A wider range of materials can thus be used for fabricating the closure of the present invention.

The convex configuration of the dome member of the present invention permits the fluid product to be easily observed at the point of discharge. Additionally, the dome member can be used as an applicator to engage and spread the discharged fluid product.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A fluid dispensing closure in combination with a squeeze-type container, said container comprising a discharge opening communicating with the container interior in which a fluid product is contained and that is sufficiently resilient to return to a substantially undeformed condition after applied squeezing forces have been removed.

said closure comprising:

a housing for being sealingly mounted to said container across said discharge opening, said housing including a peripheral wall having securing means for engaging cooperating means on said container for releasably securing said closure to said container, said housing including a top wall connected to said peripheral wall over said container discharge opening, said top wall having an upper surface exterior of said container and a lower surface facing the interior of said container, said top wall defining a cylindrical dispensing aperture providing communication between said container discharge opening and the exterior of the container above said housing, said housing further including a cylindrical collar projecting upwardly from said housing top wall upper surface around said cylindrical dispensing aperture, said collar and top wall having a generally vertically oriented venting channel that is open to said dispensing aperture, a portion of said top wall at said lower surface defining a partially circumferential venting recess opening to said venting channel, and said channel and recess together defining a vent passage; and a resilient insert member mounted within said housing cylindrical dispensing aperture, said insert member defining at its upper end a dome member projecting convexly outwardly over said container discharge opening at the top of said cylindrical collar, said dome member defining at least one slit extending through said dome member, said dome member being sufficiently resilient to have a normally closed configuration in which said slit is sealed closed at least when the pressure inside said dome member equals the pressure outside said dome member, and said dome member being sufficiently flexible to be deformed further outwardly from and relative to said normally closed configuration for opening said slit when said container is squeezed to exert a predetermined fluid pressure against the inside of said dome member whereby said fluid product can discharge from said container through said open slit, said insert member including a hollow cylindrical portion extending downwardly from said dome member through said collar and top wall dispensing aperture in circumferential sealing engagement with said collar and top wall except at said channel, said insert member including a vent valve member in the form of a flange of flexible material located below said top wall and radially extending from said hollow cylindrical portion beyond said top wall recess, said flange sealingly engaging the lower surface of said top wall around said top wall cylindrical dispensing aperture radially beyond said recess to close said vent passage to the interior of said container when the pressure inside the container is at least equal to the outside pressure, said vent valve member flange being sufficiently flexible adjacent said recess to be forced away from said housing top wall lower surface so as to open said vent passage at said recess when the pressure outside of said container exceeds the pressure inside of said container to permit exterior air to be vented down said vent passage channel, through said recess, and past said flange into said container to equalize the pressures inside and outside of the container.

2. The closure in accordance with claim 1 in which said vent valve member further includes an upwardly projecting rim on said flange for engaging said housing top wall lower surface around said cylindrical dispensing aperture radially beyond said recess to seal said vent passage closed when the pressure inside the container is at least equal to the outside pressure.

* * * * *